United States Patent [19]

Mack et al.

[11] Patent Number: 4,966,294

[45] Date of Patent: Oct. 30, 1990

[54] TAMPER-EVIDENT CLOSURE FOR WIDE MOUTH CONTAINER

[75] Inventors: Anthony C. Mack, Kalamazoo; Robin M. Robbins, Portage, both of Mich.

[73] Assignee: Fabri-Kal Corporation, Kalamazoo, Mich.

[21] Appl. No.: 464,976

[22] Filed: Jan. 16, 1990

[51] Int. Cl.[5] ..... B65D 43/08

[52] U.S. Cl. ..... 220/266; 220/265; 220/260; 220/306; 220/352; 220/355; 220/356

[58] Field of Search ..... 220/265, 266, 305, 306, 220/307, 90.2, 90.4, 90.6, 352, 355, 356, 380, 260; 215/250, 253; 229/1.5 B

[56] References Cited

U.S. PATENT DOCUMENTS

| | | | |
|---|---|---|---|
| 3,403,812 | 10/1968 | Weber | 220/266 |
| 3,773,207 | 11/1973 | Dokoupil et al. | 220/266 X |
| 4,006,839 | 2/1977 | Thiel et al. | 220/266 |
| 4,026,459 | 5/1977 | Blanchard | 229/43 |
| 4,721,210 | 1/1988 | Lawrence et al. | 206/459 |
| 4,881,656 | 11/1989 | Chumley et al. | 220/270 |

*Primary Examiner*—Stephen Marcus
*Assistant Examiner*—Stephen Cronin
*Attorney, Agent, or Firm*—Flynn, Thiel, Boutell & Tanis

[57] ABSTRACT

A tamper-evident closure for a wide mouth container. The closure member has a central panel and a downwardly opening rim cavity encircling the central panel and adapted to receive therein a top rim of the food container. The rim cavity is defined by a pair of upstanding, radially spaced skirt segments connected at their respectrive upper edges by a top rim segment. A radially outer one of the skirt segments has adjacent a lower edge thereof a radially inwardly projecting and circumferentially extending first flange adapted to snugly fit under and frictionally engage the lip on the food container. In addition, the radially outer skirt also has a radially outwardly projecting second flange contiguous with and oriented below the first flange. A plurality of generally inverted V-shaped radially outwardly projecting rim segments are integrally connected between each set of mutually adjacent circumferential ends of at least the second flange. The inverted V-shaped rim segments each have a pair of wall segments each projecting radially outwardly from a respective one of the mutually adjacent circumferential ends of at least the second flange. The pair of walls extend inclined upwardly from the second flange toward each other to and integral connection forming an apex. Each of the plural apexes defines stress concentration structure for the material of the closure member so that a lifting force applied to one of the second flanges will cause the material of the closure member to break only at the apexes.

13 Claims, 4 Drawing Sheets

TAMPER-EVIDENT CLOSURE FOR WIDE MOUTH CONTAINER

FIELD OF THE INVENTION

This invention relates to a tamper-evident closure for a wide mouth container.

BACKGROUND OF THE INVENTION

Much concern has arisen in recent years about persons introducing foreign objects into food containers that are placed for sale in stores. As a result, it is highly desirable to provide assurance to a customer that no unauthorized tampering with the closure member has occurred prior to purchase. In manufacturing closures, it has oftentimes been the practice to provide some form of special cut or slit or scores in the material of the closure so as to enhance tearing of the material of the closure at a pregiven location to evidence that the lid has been tampered with. Manufacturing techniques require, therefore, a separate cutting step or slitting step or scoring step in order to cause the closure to have the requisite characteristics providing tamper evidence when an attempt is made to remove the closure from a food container. Conversely, the food packer will use auxiliary heat shrinkable bands, heat sealed foils or adhesive labels to provide the tamper evident feature. It is desired to provide a closure which does not require the aforesaid special cuts and/or slits and/or scores and does not require the use of any bands, labels and the like, and yet provide the desirable tamper-evident characteristics for the package.

It is an object of this invention to provide a thermoplastic closure for an open topped container having tamper-evident characteristics without necessitating additional machining thereto, such as providing cutout notches and/or slits and/or scoring in the material of the closure or the use of auxiliary bands, labels and the like.

It is a further object of this invention to provide a closure, as aforesaid, which has the requisite resistance to material tearing but yet evidences tampering by a tearing of the material once a force is applied to the closure in an effort to remove it from the container.

SUMMARY OF THE INVENTION

The objects and purposes of the invention have been met by providing a tamper-evident closure for a container, which closure includes a closure member having a size to cover the open top of the container when applied thereto. In addition, the closure member has a central panel and a downwardly opening rim cavity encircling the central panel and adapted to receive therein a top rim of the container. The rim cavity is defined by a pair of upstanding, radially spaced skirt segments connected at their respective upper edges by a top rim segment. A radially outer one of the skirt segments has adjacent a lower edge thereof a radially inwardly projecting and circumferentially extending first flange adapted to snugly fit under and frictionally engage the lip on the container. In addition, the radially outer skirt also has a plurality of circumferentially spaced, radially outwardly projecting second flanges contiguous with and oriented below the first flange. A plurality of generally inverted V-shaped radially outwardly projecting rim segments are integrally connected between each set of mutually adjacent circumferential ends of at least the second flange. The inverted V-shaped rim segments each have a pair of wall segments each projecting radially outwardly from a respective one of the mutually adjacent circumferential ends of at least the second flanges. The pair of walls extend inclined upwardly from the second flanges toward each other to an integral connection forming an apex. The apex defines stress concentration structure for the material of the closure member, so that a lifting force applied to one of the second flanges will cause the material of the closure member to break only at the apexes located at opposite circumferential ends of the second flanges to which the lifting force has been applied to allow for continued tearing of the material of the closure member.

BRIEF DESCRIPTION OF THE DRAWINGS

Further objects and purposes of the invention will be apparent to persons of ordinary skill in the art upon reading the following specification and referring to the accompanying drawings, in which.

Figure 1:
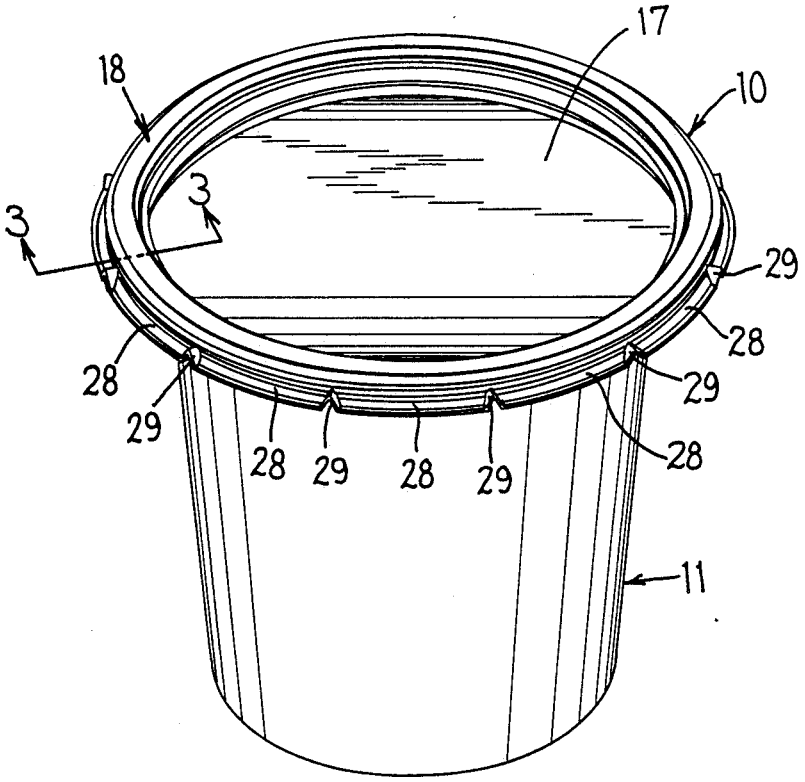
FIG. 1 is a perspective view of a closure member on a wide mouth container and containing features which embody the invention.

Certain terminology may be used in the following description for convenience in reference only and will not be limiting. The words "up", "down", "right" and "left", if used, will designate directions in the drawings to which reference is made. The words "in" and "out", if used, will refer to directions toward and away from, respectively, the geometric center of the structure and the designated parts thereof. Such terminology will include the words above specifically mentioned, derivatives thereof and words of similar import.

DETAILED DESCRIPTION

Figure 3:
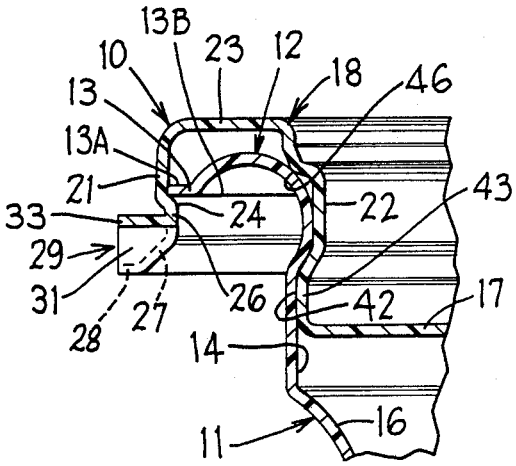
FIG. 3 is a sectional view taken along the line 3—3 of FIG. 1.

A tamper-evident closure member 10 is illustrated in FIG. 1 and is shown as a closure for an open topped, wide mouth, food container 11. It is to be understood that the use of the phrase "food container" is for discussion and description purposes only and is not to be limiting, namely, a requirement that the container is for use only with food product therein. The food container 11 includes a top rim 12 terminating in a radially outwardly projecting lip 13 that is either in the form of a horizontally extending flange 13A or a mere peripheral edge of the top rim 12. In addition, an annular sealing groove 14 is provided on an inside facing surface 16 of the food container adjacent but spaced below the top rim 12 and, in this embodiment, below a horizontal plane containing the lip 13. The top rim 12 extends arcuately radially inwardly of and above the lip 13 and between the lip and the sealing groove 14 as shown in FIG. 3. In this particular embodiment, the arcuate top rim is generally almost circular in cross section.

Figure 2:
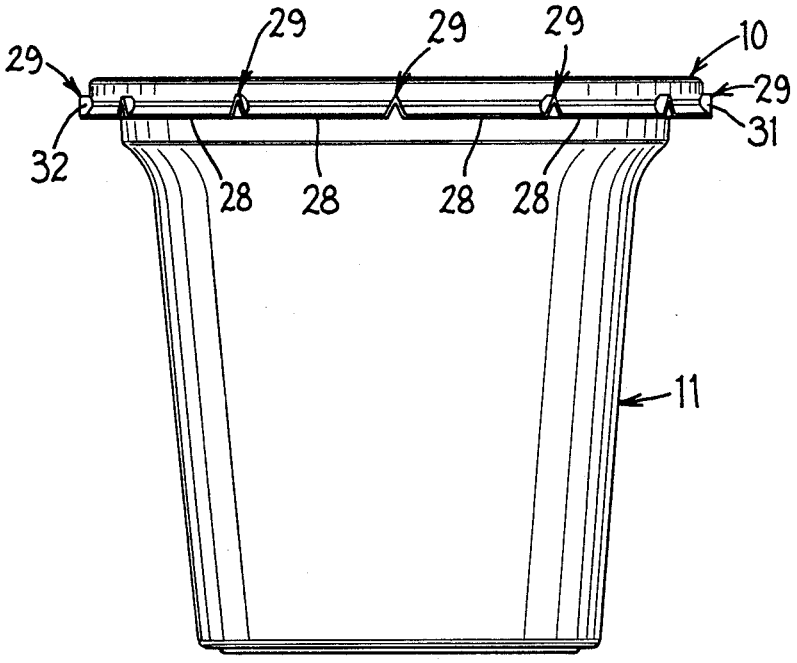
FIG. 2 is a side elevational view of the closure member and the container.

The tamper-evident closure member 10 has a size that is sufficient to cover the open top of the food container when applied thereto as shown in FIGS. 1 and 2. The closure member 10 is circular, includes a central panel 17, and a downwardly opening rim cavity 18 encircles the central panel 17 and is adapted to receive therein the top rim 12 of the food container.

The rim cavity 18 is defined by a pair of upstanding, radially spaced skirt segments 21 and 22 connected at their respective upper edges by a top rim segment 23. The radially outer one of the skirt segments, namely, the skirt segment 21, has adjacent a lower edge thereof a plurality of circumferentially spaced, radially inwardly projecting and circumferentially extending flanges 24 adapted to snugly fit under and frictionally engage the undersurface of the lip 13 on the food container 11. In addition, a downwardly extending flange 26 is connected to the radially inner edge of the flange 24 and terminates in a further radially outwardly and inclined flange 27 which, in turn, terminates at its lower edge in a radially outwardly extending flange 28. In this particular embodiment, the flange 26 extends downwardly generally perpendicular to the plane 13B containing the lip 13 on the food container 11. The inclined flange 27 extending radially outwardly from the lower edge of the flange 26 to the radially inner edge of the flange 28 is inclined to the horizontal at an angle of about 45°. The flange 28 extends in a plane that is generally parallel to the aforementioned plane 13B of the lip 13 on the food container 11.

Figure 4:
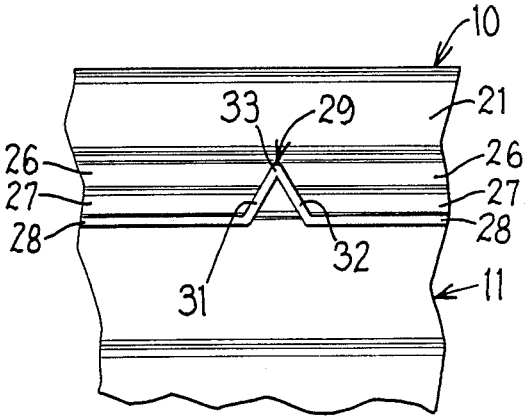
FIG. 4 is an enlarged fragmentary side view of the closure member.
Figure 9:
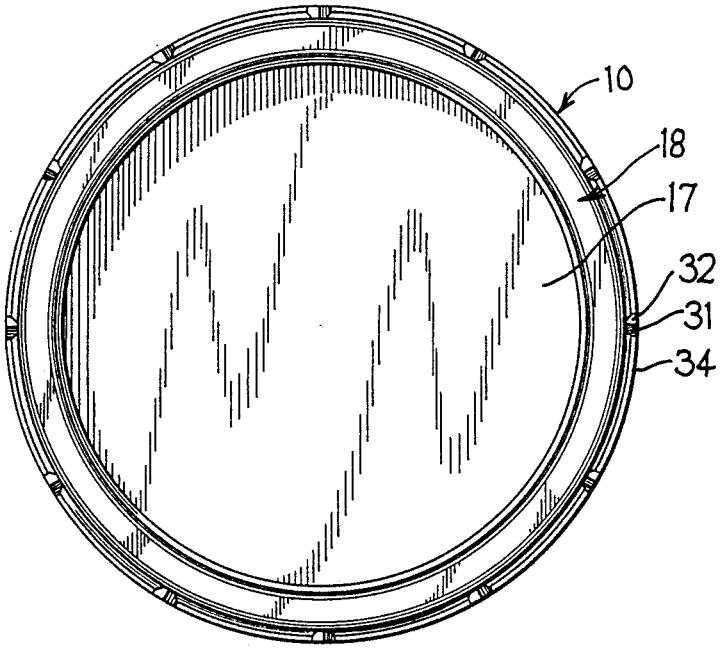
FIG. 9 is a top view of the closure member.
Figure 10:
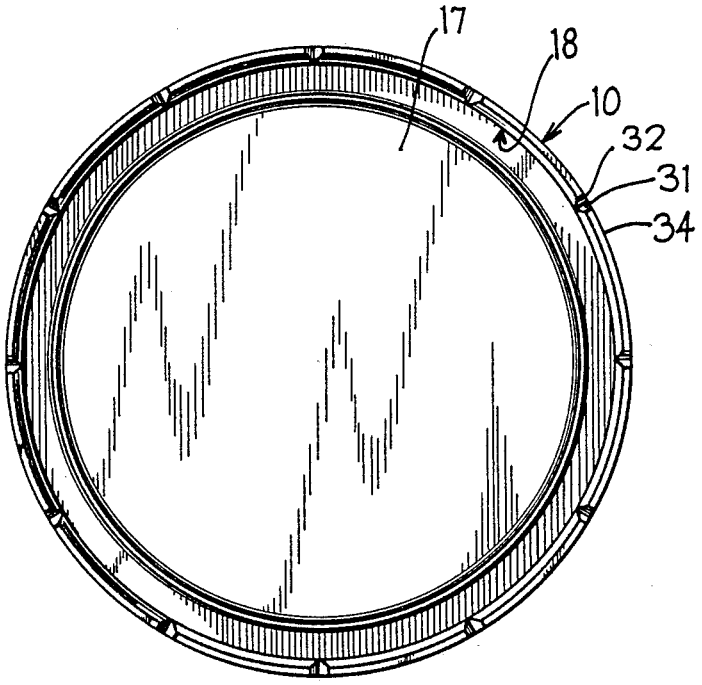
FIG. 10 is a bottom view of the closure member.

As is shown in FIGS. 3 and 4, at least the flanges 26, 27 and 28 are circumferentially spaced and integrally connected by a plurality of generally inverted V-shaped, radially outwardly projecting rim segments 29. More specifically, each inverted V-shaped rim segment 29 includes a pair of wall segments 31 and 32, each projecting radially outwardly from a respective one of the mutually adjacent, circumferential ends of the flanges 26 and 27. The walls 31 and 32 additionally extend inclined upwardly from the flanges 27 and 28 toward each other to an integral connection forming an apex 33. As will be noted from the top and bottom views of the closure member illustrated in FIGS. 9 and 10, respectively, radially outer edges of the pair of walls 31 and 32 are congruent with a continuous theoretical line 34 forming a circle and with which the radially outer edge of each of the flanges 28 is congruent.

Figure 5:
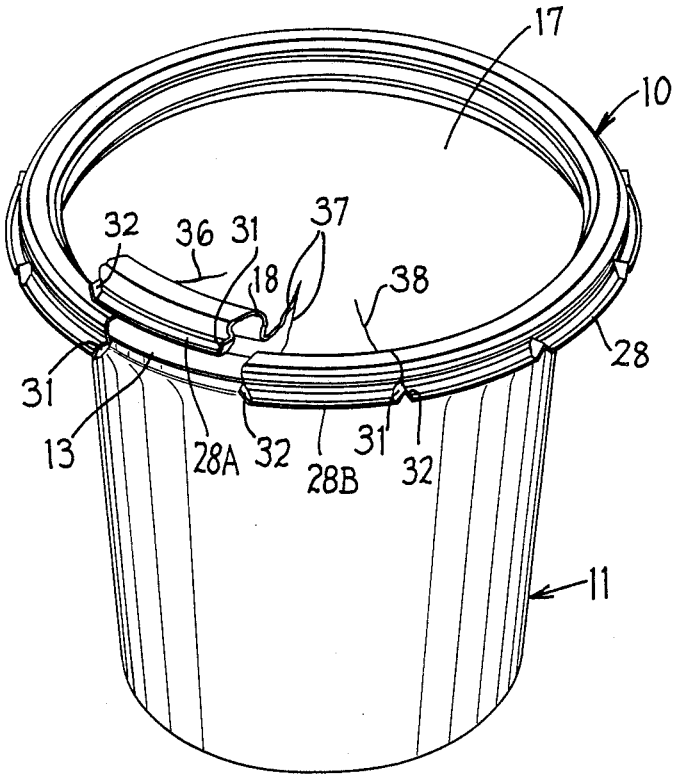
FIG. 5 is a perspective view similar to FIG. 1, except that the material of the closure member has been torn following the application of a lifting force to a radially outer edge of the closure member.

The apex 33 of the each inverted V-shaped rim segment 29 defines a stress concentration structure for the thermoplastic material of the closure member, such that a lifting force applied to flange 28 will cause the thermoplastic material of the closure member to break only at the apexes located at opposite circumferential ends of the flange segments 28 to which the lifting force has been applied. This lifting force and consequent breakage at the two apexes 33 located at opposite ends of a flange segment 28 will allow for continued tearing of the thermoplastic material of the closure member 10 as illustrated by the tear lines 36, 37 and 38 in FIG. 5, especially if a continued pulling force is applied to the flange segment 28. On the other hand, and in an effort to preserve the integrity of the sealing feature, multiple apexes 33 around the lid may be broken to facilitate removal of the lid without compromising the reusability of the closure.

Figure 8:
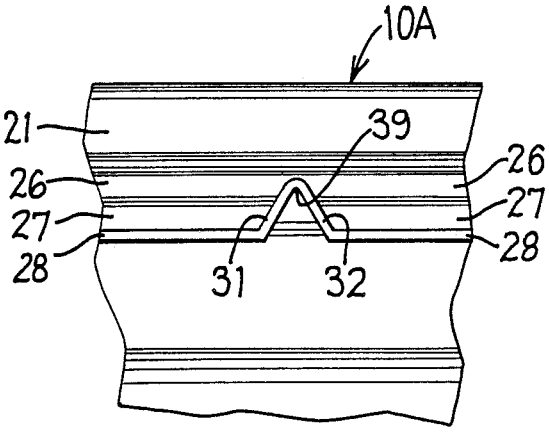
FIG. 8 is an enlarged fragmentary side view of a modified closure member.

As shown in FIG. 4, the wall segments 31 and 32 are inclined relative to each other so as to define an included acute angle that is in the range of 40° to 80°. As illustrated in FIG. 4, the angle is preferably approximately 60 . Further, the juncture or joint between the upwardly inclined wall segments 31 and 32 defines a pointed angle as illustrated in FIG. 4. As illustrated in FIG. 8, an alternate construction of the closure member 10A is provided wherein the juncture between the wall segments 31 and 32 is rounded as at 39 for purposes of increasing the force required to break the material at the apexes, so as to prevent premature breaking during shipping and/or handling.

In each of the two embodiments of the inverted V-shaped rim segments 29, the juncture between the wall segments 31 and 32 extends generally radially outwardly from the flange 26 below the flange 24. Thus, the rim segments 29 do not interfere with the snug fit of the flange 24 under the lip 13 on the food container 11.

As is illustrated in FIG. 3, the radial dimension between a perimeter of the lip 13 on the food container and a radially inwardly facing surface forming a bottom wall 41 of the annular sealing groove 14 is slightly greater than the radial dimension between a radially inwardly facing surface of the flange 26 and a radially outwardly facing surface 42 on an annular sealing bead 43 on the closure member 10. This structural relationship causes the closure member 10 to be tenaciously connected to the food container 11. As a result, an upward lifting force applied to the flange 28, such as the flange 28A illustrated in FIG. 5, will cause breakage to occur at the two apexes located at opposite ends of the flange 28A, and a continued upward pulling on the flange 28A will result in a pair of tear lines 36 and 37 to form thereby enabling the rim cavity 18 to be removed from its sealing engagement with the top rim 12 and sealing groove 14 on the food container 11. However, upward and continued pulling on the flange 28A will generally be insufficient to enable the closure member 10 to be removed from the food container 11. Instead, and preferably, an additional upward lifting force needs to be applied to at least one more flange 28, such as the flange 28B (FIG. 5) to enable the flange 28B to be moved upwardly to form the additional tear line 38. Preferably, at least two of such flanges 28A and 28B must be severed from the remaining portion of the closure member construction in order to effect a removal of the closure member 10 from the food container 11. The flanges 28A and 28B do not necessarily need to be side-by-side. In other words, they can be circumferentially spaced from one another.

Figure 6:
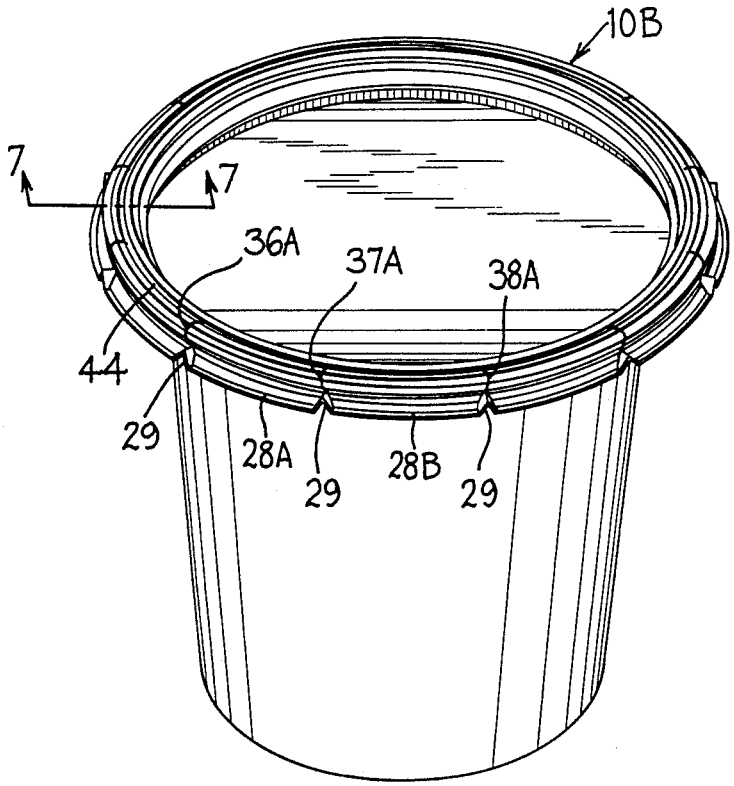
FIG. 6 is a perspective view of a modified closure member on a wide mouth container.
Figure 7:
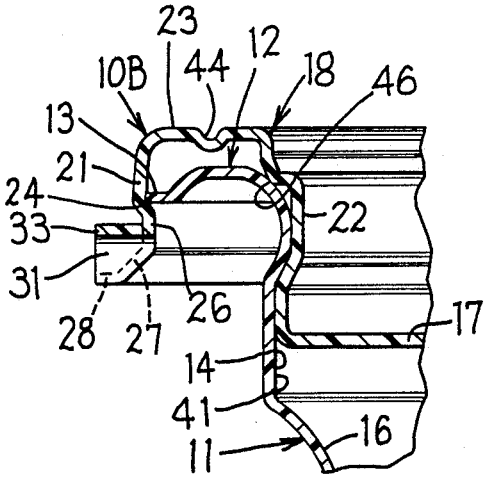
FIG. 7 is a sectional view taken along the line 7—7 of FIG. 6.

In the previously described opening of the food container, it will have been noted that the closure member 10 has been destroyed, or at least its reusability as a sealable closure member has been compromised because the tear lines 36, 37 and 38 each extend through the annular sealing bead 43. In the modified embodiment illustrated in FIGS. 6 and 7, an annular recess 44 has been provided in the top rim segment 23 of the rim cavity 18. The annular recess 44 functions as an integral hinge between the radially outer skirt segment and the radially inner skirt segment 22. In addition, the annular recess 44 functions as a substantial resistance to tearing of the thermoplastic material of the closure member through the hinge or recess 44 when a segment of the radially outer skirt has been severed from the remaining portion of the skirt assemblage and an upward pulling force is applied thereto. As is shown in FIG. 6, the tear lines 36A, 37A and 38A formed on the modified closure member 10B when an upwardly directed force is applied to the flanges 28A and 28B stop at the recess 44. As a result, and preferably following the breakage of at least two rim segments 29 at their respective apexes 33, the thermoplastic material of the modified closure member 10B will be torn until the tear lines reach the annular recess 44, after which a continued upward pulling force applied to the flanges 28A and 28B will result in a removal of the closure member 10B without destroying or compromising the annular sealing bead 43. The closure member 10B can, therefore, be reused and resealed to the food container 11. An added benefit to this feature is that the broken flange or flanges 28 form a tab which can be easily gripped and pulled to effect removal of the lid from the container.

As is illustrated in FIG. 3, an annular rib 46 is provided inside the rim cavity 18 and is located intermediate the top rim segment 23 and the annular sealing bead 43. The annular rib 46 is adapted to engage the top rim 12 of the food container 11 and serves to limit the extent to which the annular sealing bead 43 can project into the open top of the food container by reason of the annular rib 46 firmly engaging the surface of the top rim 12. This limit coincides with the annular sealing bead 43 being sealingly received in the sealing groove 14.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A tamper-evident closure for a wide mouth container having a top rim presenting a radially outwardly projecting lip thereon, said closure comprising:

a closure member having a size to cover the open top of the container when applied thereto, said closure member having a central panel and a downwardly opening rim cavity encircling said central panel and adapted to receive therein the top rim of the container, said rim cavity being defined by a pair of upstanding radially spaced skirt segments connected at their respective upper edges by a top rim segment, a radially outer one of said skirt segments having adjacent a lower edge thereof a radially inwardly projecting and circumferentially extending first flange adapted to snugly fit under and frictionally engage the lip on the container, and a plurality of circumferentially spaced, radially outwardly projecting second flanges, each contiguous with and oriented below said first flange;

a plurality of generally inverted V-shaped, radially outwardly projecting, rim segments integrally connected between each set of mutually adjacent circumferential ends of said second flanges, said inverted V-shaped rim segments each having a pair of wall segments each projecting radially outwardly from a respective one of said mutually adjacent circumferential ends of at least said second flanges, said pair of walls extending inclined upwardly from at least said second flanges toward each other to an integral connection thereof forming an apex, said apex defining a stress concentration means for the material of said closure member such that a lifting force applied to one of said plural second flanges will cause the material of said closure member to break only at said apexes located at opposite circumferential ends of said second flanges to which said lifting force has been applied to allow for continued tearing of said material of said closure member.

2. The closure according to claim 1, wherein at least said snug fit of said first flange under the lip on the container is sufficient enough to define a means requiring a lifting force to be applied to at least one of said plural second flanges, so that the material of said closure member at opposite circumferential ends of each thereof is broken only at said apexes, in order to enable a removal of said closure member from the container by a tearing of the material of at least said rim cavity and said central panel.

3. The closure according to claim 1, wherein said first flange includes a radially inwardly extending first flange segment, an upper surface thereof snugly and frictionally engaging under the lip on the container; and wherein said second flanges are integrally formed on said first flange segment adjacent a radially inner edge thereof and includes second and third flange segments, said second flange segment thereof extending downwardly away from an underside of said first flange segment, and terminating in a radially outwardly extending said third flange segment.

4. The closure according to claim 3, wherein said pair of wall segments each project radially outwardly from a respective one of said mutually adjacent circumferential ends of said second flange segments and circumferentially upwardly from said third flange segments toward said apex.

5. The closure according to claim 4, wherein said apex includes joint means for integrally joining mutually adjacent upper edges of said pair of wall segments, said joint means extending generally radially outwardly from said second flange segment below said first flange segment.

6. The closure according to claim 3, wherein said second flange segment includes a further flange segment integrally formed between said second and third flange segments, said second flange segment extending downwardly from said first flange segment generally parallel to a central axis of said closure member, said further flange segment extending at an inclined angle radially outwardly and downwardly therefrom to a radially inner edge of said third flange segment.

7. The closure according to claim 1, wherein the container further includes an annular sealing groove on an inside facing surface thereof adjacent but spaced below the top rim and below a plane containing the lip, the top rim extending arcuately radially inwardly of and above the lip and between the lip and the sealing groove; and wherein a radially inner one of said skirt segments extends between said top rim segment and said central panel and includes an annular radially outwardly extending sealing bead adapted to be sealingly received in the annular sealing groove in the container, and a radially outwardly extending annular rib intermediate said top rim segment and said annular sealing bead, said annular rib being adapted to engage said top rim of the container to limit the extent to which said annular bead can project into the open top of the container.

8. The closure according to claim 7, wherein said annular rib and said annular bead include axially spaced, radially facing annular surfaces that are generally coaxial.

9. The closure according to claim 7, wherein a radial dimension between a perimeter of the lip on the container and a radially inwardly facing surface forming a bottom wall of the annular sealing groove on the container is slightly greater than a radial dimension between a radially inwardly facing surface on said second flanges and a radially outwardly facing surface on said annular sealing bead whereby said closure member is tenaciously connected to the container.

10. A tamper-evident closure for a wide mouth container having a top rim presenting a radially outwardly projecting lip thereon, said closure comprising:

a closure member having a size to cover the open top of the container when applied thereto, said closure member having a central panel and a downwardly opening rim cavity encircling said central panel and adapted to receive therein the top rim of the container, said rim cavity being defined by a pair of upstanding radially spaced skirt segments connected at their respective upper edges by a top rim segment, a radially outer one of said skirt segments having adjacent a lower edge thereof a radially inwardly projecting and circumferentially extending first flange adapted to snugly fit under and frictionally engage the lip on the container, and a plurality of circumferentially spaced, radially outwardly projecting second flanges, each contiguous with and oriented below said first flange;

a plurality of generally inverted V-shaped, radially outwardly projecting, rim segments integrally connected between each set of mutually adjacent circumferential ends of said second flanges, said inverted V-shaped rim segments each having a pair of wall segments each projecting radially outwardly from a respective one of said mutually adjacent circumferential ends of at least said second flanges, said pair of walls extending inclined upwardly from at least said second flanges toward each other to an integral connection thereof forming an apex, said apex defining a stress concentration means for the material of said closure member such that a lifting force applied to one of said plural second flanges will cause the material of said closure member two break only at said apexes located at opposite circumferential ends of said second flanges to which said lifting force has been applied to allow for continued tearing of said material of said closure member; and means defining an upwardly opening annular groove provided in said top rim segment of said closure member for defining an integral hinge between said radially outer skirt segment and said radially inner skirt segment, said hinge further providing a substantial resistance to tearing of said material of said closure member therethrough when a segment of said radially outer skirt has been severed from the remaining portion thereof and an upward pulling force is applied thereto, thereby preserving and keeping said annular sealing bead from becoming torn, so that said closure can be reused and resealed to said container.

11. The closure according to claim 10 wherein said apexs between respective said wall segments defines a pointed angle.

12. The closure according to claim 10, wherein said apexs between respective said wall segments is purposefully rounded so as to provide an adequate resistance to premature breakage at said apexes, thereby requiring a substantial lifting force to effect a breakage at said apexes.

13. The closure according to claim 10, wherein radially outer edges of said pair of walls are congruent with a continuous theoretical line forming a circle and with which said radially outer edge of each of said plural second flange means is congruent.

* * * * *

UNITED STATES PATENT AND TRADEMARK OFFICE

CERTIFICATE OF CORRECTION

PATENT NO. : 4,966,294

DATED : October 30, 1990

INVENTOR(S) : Anthony C. MACK et al.

It is certified that error appears in the above-identified patent and that said Letters Patent is hereby corrected as shown below:

Column 8, line 8; change "two" to ---to---.

Column 8, line 27; change "apexs" to ---apexes---.

Column 8, line 30; change "apexs" to ---apexes---.

Signed and Sealed this

Twenty-third Day of June, 1992

*Attest:*

DOUGLAS B. COMER

*Attesting Officer*

*Acting Commissioner of Patents and Trademarks*